United States Patent [19]

Morris

[11] Patent Number: 4,510,641

[45] Date of Patent: Apr. 16, 1985

[54] SCRUBBING PAD

[75] Inventor: Kenneth L. Morris, Pittsford, N.Y.

[73] Assignee: Mobil Oil Corporation, New York, N.Y.

[21] Appl. No.: 549,851

[22] Filed: Nov. 9, 1983

[51] Int. Cl.[3] ..... A47L 13/17

[52] U.S. Cl. ..... 15/118; 15/209 C; 15/244 C; 401/201

[58] Field of Search ..... 15/209 B, 209 C, 244 B, 15/105, 118; 51/400–401; 401/23, 201

[56] References Cited

U.S. PATENT DOCUMENTS

| | | | |
|---|---|---|---|
| 2,107,636 | 2/1938 | Kingman | 15/209 B X |
| 2,899,697 | 8/1959 | Von Kohorn et al. | 401/201 X |
| 3,038,187 | 6/1962 | Nathanson | 15/118 |
| 3,066,347 | 5/1962 | Vosbikian et al. | 401/201 |
| 3,167,805 | 2/1965 | Zuppinger et al. | 401/201 |
| 3,175,331 | 3/1965 | Klein | 51/400 |
| 3,288,579 | 9/1966 | Coates et al. | 51/295 |
| 3,377,151 | 4/1968 | Lanham | 51/295 |
| 3,428,405 | 2/1969 | Posner | 401/201 |
| 3,431,689 | 3/1969 | Schnabel | 51/400 |
| 3,468,096 | 9/1969 | Franz | 401/201 X |
| 3,581,447 | 6/1971 | Fallvene | 51/400 |
| 4,462,135 | 7/1984 | Sanford | 15/105 |

*Primary Examiner*—Chris K. Moore

*Attorney, Agent, or Firm*—Alexander J. McKillop; Michael G. Gilman; Edward J. Trojnar

[57] ABSTRACT

A scrubbing pad having an elongated flattened body with opposed major surfaces of different textures such as steel wool and reticulated foam. The pad has an interior pocket, accessible through a peripheral opening, which is lined with a netting of plastics material to hold a replaceable cleaning material.

11 Claims, 7 Drawing Figures

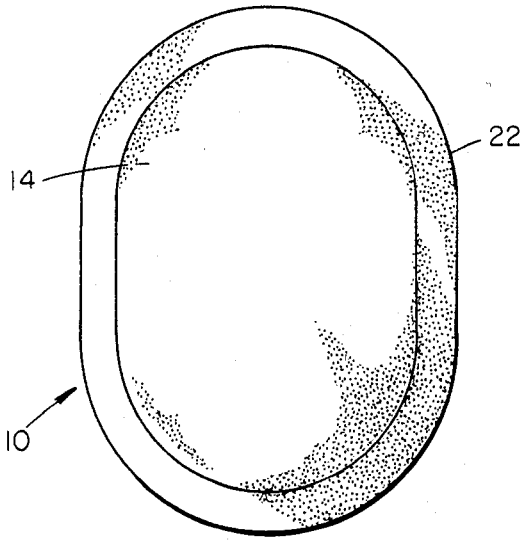
FIG. 1
FIG. 2
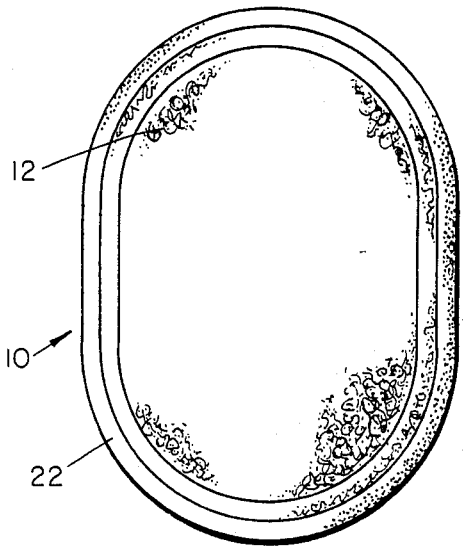
FIG. 3
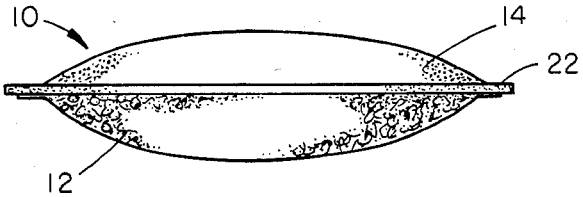
FIG. 4
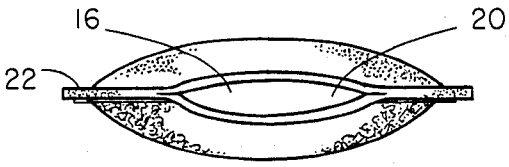

SCRUBBING PAD

BACKGROUND OF THE INVENTION

It is known to form a scrubbing or scouring pad of reticulated foam material which is efficient for scrubbing pots and pans, especially ones lined with polytetrafluoroethylene ("Teflon"—registered trademark) and it is also known to form scouring pads made of steel wool having a soap or other cleanser permeated into the intertices of the steel wool. In the latter type pad the effective life is generally ended when the soap or cleansing material is exhausted and the user must therefor be careful not to use too much water with the scouring pad, otherwise, the life will be shortened. Various combinations of different materials combined in a single scouring pad have been proposed for example see U.S. Pat. Nos. 3,066,347 (Vosbikian et al), 3,175,331 (Klein), 3,428,405 Posner, and 3,581,447 (Fallvene).

SUMMARY OF THE INVENTION

It is an object of the present invention to furnish a scouring pad having two major surfaces of different textures, one composed of randomly oriented metallic fibers preferably made of a non-rusting metal such as stainless steel and the other major surface composed of a reticulated plastics foam material.

Is a further object of the invention to form a scouring pad having an interior pocket to hold a renewable supply of soap or other cleaning material, that pocket being lined with a netting of plastics material so as to maintain the soap insert in place while still permitting the lining to be permeable to soap passing therethrough.

Is another object of this invention to form a scouring pad having the major portion of the peripheral edges adhesively secured together, such as by a hot melt adhesive, so as to maintain integrity of the scouring pad and prevent fraying of the edges.

BRIEF DESCRIPTION OF THE DRAWINGS

The foregoing and other objects will become apparent upon a review of the attached drawings which form a part of this application for patent and are given by way of example and are not limitation in which:

FIG. 1 is a plan view of the scrubbing pad of this invention showing the major surface of reticulated foam material;

FIG. 2 is a plan view showing the side opposite to that shown in FIG. 1 which is made of metal fibers;

FIG. 3 is a side view of the present invention;

FIG. 4 is an end view of the pad slightly compressed in the sideward direction to open the end having an opening therein;

DESCRIPTION OF A PREFERRED EMBODIMENT

Figure 5:
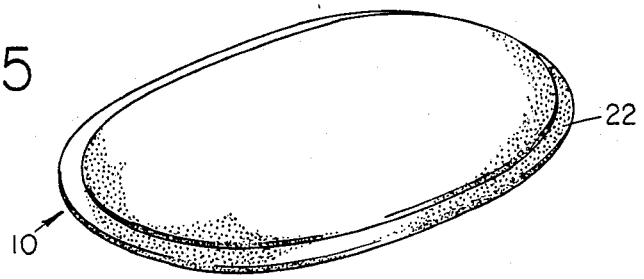
FIG. 5 is a perspective view of the present invention.

Referring now to the drawings in detail in FIGS. 1 and 2 there is showing a plan view of each side of the present invention having a body 10 composed of a first major surface 12, that surface consisting of randomly oriented metal fibers forming a non-woven cloth layer. The metal is preferably a material which is non-corroding and non-rusting such as stainless steel. The metal fibers are of a sufficient length to be intertwined with each other so as to prevent individual fibers from being readily pulled out of the surface. In the alternative the metal fibers may be held in place by the process disclosed in assignee's co-pending application Ser. No. 530,323, filed Sept. 8, 1983, of W. J. Clayton.

On the other side of the body 10 is a second major surface 14 which is composed of a reticulated foam layer such as polyethylene which is of open cell construction so as to permit permeation therethrough by a soap, detergent or other cleaning material.

The two major surfaces are secured together around a major portion of their common periphery 22 preferably by a heat cureable adhesive such as a hot melt adhesive so as to hold the edges in contact and avoid fraying or separation thereof. The adhesive does not extend around the entire periphery since there is an opening 20 into a pocket 16 which is lined with a netting 18 of plastics material. This netting 18 preferably extends to the periphery of the major surfaces and is secured in place by the same adhesive which is used to hold the major surfaces 12 and 14 together. The netting is preferably secured to the edge of the respective major surface adjacent the edge of the opening 20 so as to make a well defined entrance for the pocket so that soap or detergent material can readily be inserted therein. A replaceable soap containing element such as a soap saturated foam or other plastics carrier or solid piece of soap or bar of detergent is receivable within the pocket and can of course be readily replaced as the soap is consumed. Of course the soap can readily permeate through the plastic netting and through the reticulated foam material or through the steel wool material. As the soap softens, it is held in place by the netting 18.

The pad has a natural tendency for the two major surface to bias toward contact with each other, that is to close the opening 20 and to hold soap or detergent material in the pocket 16 unless the sides are pinched together. Thus in FIG. 4 the opening 20 is readily visible because the pad is shown slightly compressed in the sideward direction.

Figure 6:
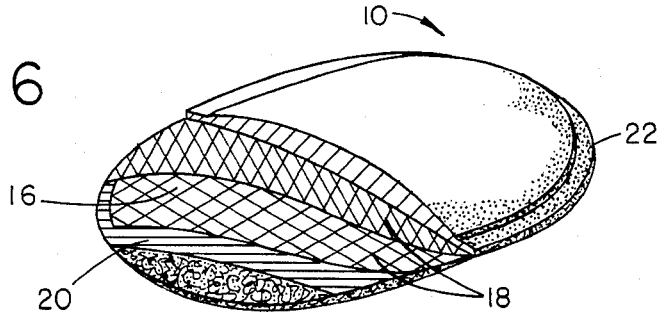
FIG. 6 is a perspective view similar to FIG. 5 but with the upper layers partially cut away.

FIG. 6 more clearly shows how the netting 18 is sandwiched between the two major surfaces and extends into the area of the hot melt adhesive.

Figure 7:
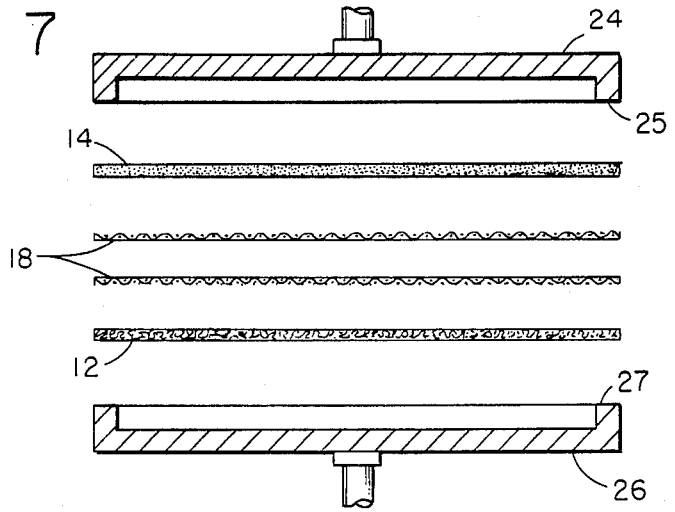
FIG. 7 diagrammatically illustrates one method of making the present invention.

Referring now to FIG. 7, the scouring pad of the present invention is made by a method wherein the peripheral edges of a pad are coated with a hot melt adhesive radially inwardly for about one quarter inch. That pad, comprising an assembly of four layers—retriculated foam 14, steel wool 12 and two layers of plastics netting 18 sandwiched therebetween—is then placed between the plates 24 and 26 of a press and compressed together. Plates 24 and 26 each have an upstanding edge 25 or 27 to apply pressure directly to the periphery to which the adhesive has been previously applied. The plates preferably have heating means therein, such as electric resistance heating elements, to melt the adhesive. Alternatively the pressing operation could be conducted in a heated atmosphere such as an oven. Many adhesives are available for this purpose and it is preferable to choose one with a relatively low activating temperature, say around 300° F. so as to avoid delterious effect on the plastics material.

Mass production of the scrubbing pads of this invention would of course involve pressing and heating equipment capable of handling a large number of pads at one time which would be cut from large sheets of material, for example by die cutting.

If it were desired to incorporate the invention of the W. J. Clayton patent application previously mentioned, that is to cover the steel wool with a thermoplastic resin to hold the fibers in place, that step could be done at the same time that the pad periphery is heated and adhered.

I claim:

1. A scouring pad comprising:

an elongated flattened body having two major surfaces of appropriately the same size, the first of said surfaces being composed of randomly oriented metallic fibers forming a non-woven cloth layer and the second major surface being composed of a reticulated plastics foam material;

means adhesively securing the edges of said first and second major surfaces together only around a major portion of their mating peripheries so as to form a pocket therebetween, said pocket being accessible through a portion of said periphery which is not adhesively secured;

two layers of netting of plastics material sandwiched between said major surfaces and lining said pocket to form a permeable holder for a cleaning substance therebetween, the edges of the netting being also adhesively secured together around a major portion of their peripheries.

2. The pad of claim 1 in which the means securing the periphery is a heat cureable adhesive.

3. The pad of claim 2 in which the heat cureable adhesive is a hot melt adhesive.

4. The pad of claim 2 in which the heat cureable adhesive has an activating temperature below the temperature which would damage the plastics foam material.

5. The pad of claim 2 in which the activating temperature of the heat curable adhesive is below 500° F.

6. The pad of claim 1 in which the metallic fibers are of stainless steel.

7. The pad of claim 1 in which the pocket is accessible through an opening where the periphery of the pad is not adhesively secured, the plastics netting at said opening being secured to its respective adjacent major surface.

8. A method of manufacturing a scouring pad having two major surfaces of different materials and a pocket therebetween comprising:

forming a first major surface from a non-woven material of randomly oriented metallic fibers;

forming a second major surface of a reticulated plastics foam material;

coating the major portion of the periphery of at least one of said major surfaces with an adhesive;

assembling said two major surfaces together with two layers of netting of plastics material sandwiched therebetween so that the peripheries of said two major surfaces are in alignment;

pressing said peripheries together so as to cure said adhesive and secure said major surfaces together only over a major part of their common periphery so as to form a pocket between said major surfaces while leaving an opening to said pocket through said periphery at the peripheral portion when there is no adhesive.

9. The method of claim 8 in which the adhesive is a heat cureable adhesive and including the step of heating said periphery while pressing.

10. The method of claim 8 in which the heat cureable adhesive is a hot melt adhesive.

11. The method of claim 8 including placing the assembly of major surfaces and plastics netting between the plates of a press, each plate having an upstanding edge to contact said common periphery and heating at least one of said upstanding edges to cure said adhesive.

* * * * *